US005243408A

United States Patent [19]

Whitman, III

[11] Patent Number: 5,243,408

[45] Date of Patent: Sep. 7, 1993

[54] METHOD AND APPARATUS FOR DETECTING WEB DISCONTINUITIES

[75] Inventor: Hobart A. Whitman, III, Asheville, N.C.

[73] Assignee: P. H. Glatfelter Company, Spring Grove, Pa.

[21] Appl. No.: 731,469

[22] Filed: Jul. 17, 1991

[51] Int. Cl.[5] ..... G01N 21/86; G01N 21/89

[52] U.S. Cl. ..... 356/430; 356/429; 356/431

[58] Field of Search ..... 356/429, 430, 431

[56] References Cited

U.S. PATENT DOCUMENTS

| | | | |
|---|---|---|---|
| 2,264,725 | 12/1941 | Shoupp et al. | 250/308 |
| 3,316,760 | 5/1967 | Ward | 73/159 |
| 3,432,672 | 3/1969 | Bessonny et al. | 73/600 |
| 3,519,922 | 7/1970 | Nash et al. | 324/671 |
| 3,577,955 | 5/1971 | Palmer | 116/204 |
| 3,824,021 | 7/1974 | Axelrod et al. | 356/430 |
| 4,048,510 | 9/1977 | Clarke et al. | 356/430 |
| 4,252,443 | 2/1981 | Lucas et al. | 356/430 |
| 4,253,113 | 2/1981 | Decavel et al. | 356/430 |
| 4,314,747 | 2/1982 | Haraguchi | 354/25 |
| 4,498,240 | 2/1985 | Van Dijk | 33/147 |
| 4,559,451 | 12/1985 | Curl | 356/431 |
| 4,644,174 | 2/1987 | Ouellette | 356/430 |
| 4,870,291 | 9/1989 | Hayashi et al. | 356/429 |
| 4,901,577 | 2/1990 | Roberts | 73/600 |

*Primary Examiner*—Vincent P. McGraw
*Assistant Examiner*—La Charles Keesee
*Attorney, Agent, or Firm*—Kerkam, Stowell, Kondracki & Clarke

[57] ABSTRACT

The detection of abrupt changes in opacity of a moving sheet resulting from, for example, an overlap type splice is provided. The web material is fed between two identical light emitter/detector pairs such that its opacity is measured. An abrupt change in web thickness passing through one light emitter/detector pair is sensed as a change in web opacity. The difference and resulting imbalance with the opacity signal from the other light emitter/detector pair, not yet interrupted with the abrupt change, is utilized to indicate the presence of the defect which, in this application, could be an overlap splice. The disclosed invention, although adaptable to thicker textile webs, specifically relates to a device for the detection of overlap splices in a moving sheet representative of all the paper types required by the cigarette, printing, and labeling industries.

2 Claims, 1 Drawing Sheet

METHOD AND APPARATUS FOR DETECTING WEB DISCONTINUITIES

THE INVENTION

This invention provides means for the detection of abrupt changes, such as thickness, edge aberrations, cracks, ruptures, and edge marking inks, of a moving sheet or web. The web material is fed between two identical light emitter/detector pairs such that its opacity is measured. An abrupt change in web, such as thickness passing through one light emitter/detector pair, is sensed as a change in web opacity. The difference and resulting imbalance with the opacity signal from the other light emitter/detector pair, not yet interrupted with the abrupt change, is utilized to indicate the presence of the defect or discontinuity, which, in this application, could be an overlap splice.

The disclosed invention, although adaptable to textile webs, specifically relates to a device for the detection of overlap splices in a moving sheet representative of all the paper types required by the cigarette, printing and labeling industries.

BACKGROUND OF THE INVENTION

During the manufacturing of paper, it is often necessary to splice separate sections together in order to maintain a continuous running sheet. Several splices within a paper roll wound for shipment and/or storage is not uncommon. As this continuous sheet is unwound in a printing process, whether for publications or labels, or in another process such as the manufacture of cigarettes, splices must be detected for their removal. This is necessary, not only to avoid process breakdown, but also to prevent splices from appearing in the final product. Splices are especially unacceptable in cigarettes and pharmaceutical labeling.

Greater demands are placed upon splice detection as paper manufacturers are beginning to use repulpable splice materials and adhesives which are necessarily transparent and colorless. Conventional splice detectors, based on optical systems, have historically depended upon opaque markers to indicate their presence. As these markers are unacceptable in paper recycling, other detection methods are being used. These methods employ gamma radiation, ultrasonics, mechanical contact with a moving sheet, and the measurement of abrupt capacitance change between electrodes where the moving sheet acts as a dielectric. All these methods have limitations, especially with materials such as cigarette paper and fine printing paper. A common problem shared by all commercial systems is the need for readjustment to compensate for change from one material type to another, not to mention that needed for changes induced by ambient environment and component aging. Web speed constraints are necessary to prevent web tearing from sensor to web contact and/or web blockage from web flop and vibration within a narrow detector sensing gap.

U.S. Pat. Nos. 4,498,240; 4,314,757; 3,316,760; and 3,577,955 all relate to mechanical methods for splice detection and require some form of physical contact with the moving web. Where these methods might be highly successful with thick, heavy web materials, they would present a threat to cosmetic appearance and tearing to the much lighter sheet materials which are inherently fragile. Should a mechanical device be scaled down to a workable configuration, vibrational movement, inherent in machine running and web movement as compared to that from a typical splice, would be significant enough to trigger false splice signals.

U.S. Pat. No. 2,264,725 utilizes gamma radiation which is transmitted through the moving sheet to measure web thickness and, subsequently, a splice which would be a momentary thickness change. A plurality of sensors is used differentially to compensate for slight variances in material; however, the material must be metallic or dense enough to attenuate the incident gamma radiation to useful levels.

U.S. Pat. No. 4,901,577 describes a device designed for web splice detection in a printing press by measuring abrupt changes in attenuated ultrasonic signals transmitted through the moving sheet. This approach is similar to a light source detector system where light, instead of ultrasonic radiation, is used. In this particular patent, only one sensor system is used with no compensational features for inherent thickness changes within a given product. The comparable light system has been unsuccessful because of false signals being generated, even with continuous manual adjustment.

U.S. Pat. No. 3,432,672 uses light emitter/detector pairs to measure a change in reflection from incident light resulting from logo or a visible marker used to identify a splice. The intent of the disclosed is to eliminate the requirement for a visible identification marker.

U.S. Pat. No. 3,519,922 discloses a device that detects an abrupt thickness change in a moving sheet representing a typical splice. It was particularly designed for sheet materials such as thin papers and uses the material's dielectric properties to induce a proportional capacitance change to a series of electrically charged electrode plates separated by an air gap through which the web splice passes. Since the air gap is a significant portion of the total dielectric, it must be held to a minimum spacing in order for the web dielectric change from a splice to faithfully generate a detection signal. This poses a threat to web travel, especially at high speeds where web flop, especially in a big machine, is significant. Speed constraints would have to be enforced to avoid web tearing. This device uses a plurality of sensors to compare a splice disturbance with a reference, and effectively compensates for the normal web variations within a given product. The patent does express a need for periodic adjustment to "retune" system electronics. This would also be necessary if sensitivity increases were required to monitor thinner than normal sheet materials.

The disclosed overcomes the aforementioned limitations taught in the referenced U.S. patents by making the following unnecessary:

1. Web-to-sensor contact which threatens customer appearance of webs and introduces risk of web breakage.
2. Narrow sensor gap spacing through which a web must pass (U.S. Pat. No. 3,519,922) and the web speed constraints that result.
3. Printed markers, logo, or opaque non-repulpable adhesive for splice identification (U.S. Pat. No. 3,432,672).
4. Appreciable web thickness.
5. Periodic system readjustment to account for different web types, changes in industrial environment, and normal aging of components.

As is known in the art, signals from detected splices can be easily routed to perform a number of various functions besides alarm activation, depending upon specific requirements. The following are typical, but not limited to, examples that could be utilized in the industry.

1. Automatic machine stop (stoppage of web movement).
2. Splice tracking
   A position encoder, mechanically linked to the moving web could be activated by a splice signal. When a predetermined count, representative of a specific splice location, is reached, the splice could be illuminated for observation. Subsequent count settings could decelerate the machine (and web movement) to a complete stop at an exact splice position for its removal, examination, etc.
   Two or more independent web systems could be synchronized so that each splice in each web would meet and join at a chosen common point. Position encoders would be used as in the former example, but to the extent of invoking speed/positional changes in each system to make this possible.
3. Splice Counting
   Splice signals could be counted to hold product within specifications relating to maximum splice occurrence.
4. Identification Marker
   A splice signal could activate an edge marker to indicate splice locations. A position encoder could also be used to identify the splice, as it would track the splice and apply edge marking at a specific location on the machine.

SUMMARY OF THE INVENTION

Throughout the specification and claims, the term "discontinuity" means any change in web thickness caused by an overlap splice, edge aberrations, edge cracks, web ruptures and edge marking inks and the like.

According to the invention, the detection of discontinuities is achieved by a combination of two identical light emitter/detector sensor pairs. They are spaced apart along the plane of web movement at a distance slightly greater than the widest width anticipated for a typical overlap splice. The invention equally applies to the detection of web tear-outs, as the two sensors could be positioned in a place perpendicular to web movement.

The emitters of each sensor pair are electrically connected in series in order to share equal amounts of electrical current in order to approach and maintain the best match in output brightness. The detector portions of the sensor pairs are on the opposite side of the moving web from the emitters and measure the amount of attenuated light transmitted through the web. In effect, the electrical signals produced by the detectors are proportional to web thickness and opacity. Since web variances within the short distance between measurement points is very slight, if not negligible, the detector output signals are essentially equal. Each of these signals is separately, but equally, amplified, after which they are connected differentially to produce a composite null or zero signal.

U.S. Pat. No. 3,519,922, using capacitance sensors, accomplishes, in part, the same thing with its bridge circuit and, as with the disclosed, is unaffected by the nature of material (i.e., color, caliper, density, etc.). This invention does, however, offer a novelty and a significant advantage and improvement over this patent and the prior art in that the nulled differential signal not only triggers an alarm when balance is lost from a passing discontinuity but provides an automatic, continuous compensation signal to maintain system balance and null under all the variances induced by inherent web changes, component aging, and environmental contamination. This composite null signal is first amplified to useful levels, routed to each detector amplifier for compensation, and finally routed to a threshold circuit which responds to a discontinuity signal, which, in turn, triggers an alarm.

DETAILED DESCRIPTION OF THE INVENTION

Figure 1:
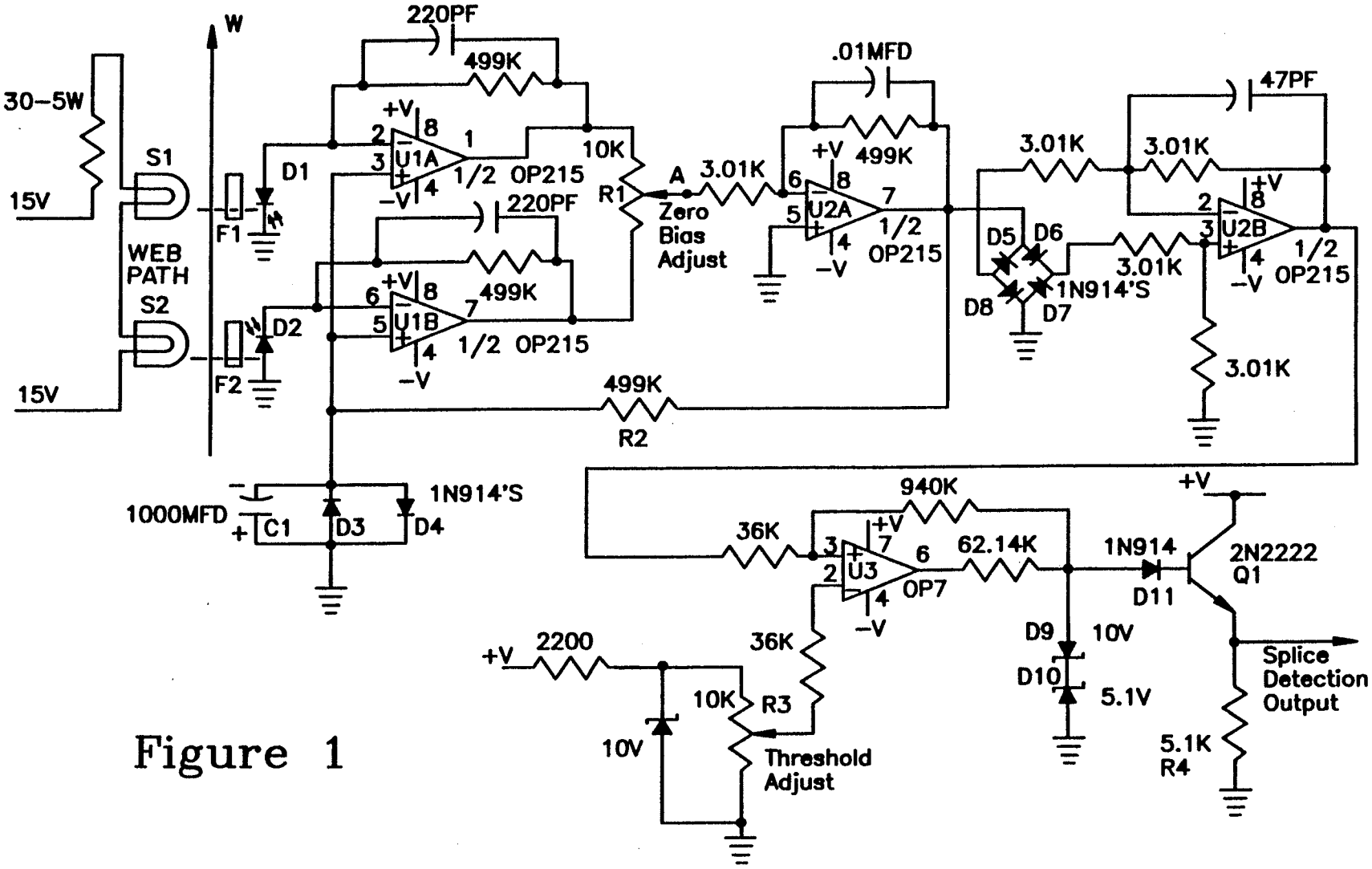
FIG. 1 is a schematic diagram of a preferred embodiment of the invention.

An operational description of the invention, with reference to the drawing and in reference to an overlap splice is as follows:

Two light emitter/detector pairs, S1D1 and S2D2, are positioned and spaced apart along the path of web movement at a distance slightly greater than the width of an anticipated overlap splice. The light path from emitter to detector of each pair is interrupted by a moving web W and low pass optical filters F1 and F2. Identical emitters S1 and S2 radiate similarly as they are electrically connected in series. Identical detectors D1 and D2 measure the attenuation of light transmitted through the web. The anode of D1 and the cathode of D2 are connected to the (−) inputs of amplifiers U1A and U1B, respectively, to produce opposing output signals. The composite of these signals nulls at point A, the mid-position of the wiper arm of potentiometer R1. Null is lost when system balance is lost, and occurs from normal variances in the moving web through detector pairs S1D1 and S2D2, from component drift, and from the effects of the industrial environment, such as dust collection in the light detector optical parts. The small signal at point A that results is taken to amplifier U2A, where it is amplified to a level useful for offset compensation. This boosted signal is filtered from fast, abrupt changes that would normally be produced by web splices and tear-outs by R2 and C1. The result is a slow, gradual signal change representative only of unbalances to be corrected. The filtered signal is applied to the (+) inputs of detector amplifiers U1A and U1B. The overall effect is to lower the output signal from one amplifier and raise the output signal of the other in a direction to oppose offset and restore system balance. The effect is bi-directional depending upon the polarity of the unbalance. Diodes D3 and D4 limit the filtered feedback signal to plus or minus 700 millivolts to prevent the detector's amplifiers from saturating and/or operating outside their optimum range. Potentiometer R1 also provides adjustment, which experience has shown to be one-time, for an initial setup. It is made with the moving sheet or web removed from the sensor gaps for a minimum feedback bias at the (+) inputs of amplifiers U1A and U1B. This is typically several millivolts. This is normal and accounts for the slight differences in system components, and also assures equal feedback compensation for either offset polarity. Correction for imbalance is continuous and automatic.

This is a significant advantage and also a departure from the prior art, specifically for systems using a pair or plurality of sensors. Bridge circuits are common practice and are designed to detect imbalance; however, the prior art provides no such compensation and/or assumes that compensation is unnecessary. U.S. Pat. No. 3,519,922, a dual system, provides a manual adjustment to restore balance. Singular sensor systems have no comparison reference and would require continuous adjustment at the sacrifice of producing occasional false signals. Mechanical systems are more forgiving as their application is restricted to relatively thick webs where splices and similar anomalies would produce a significant change.

A splice or tear-out in the web of the disclosed invention produces an abrupt system imbalance. Since the splice cannot interrupt both sensors simultaneously, an abrupt signal reduction due to greater detected opacity from sensor pair S2D2, for example, appears at the amplified output of U1B. System balance is suddenly lost at point A in favor of the greater output from sensor S1D1, and amplifier U1A which, at this point in time, serves as a reference. As the imbalance is effectively amplified in two stages, the output at U2A is saturated at maximum level. Since these amplifiers, U1A, U1B, and U2A, are bi-directional, symmetrical amplification applies to both positive and negative polarities. In this example, with the splice positioned at sensor pair S2D2, an amplified, saturated signal appears at pin 7 of amplifier U2A. This signal, because of its abruptness, is isolated from the balancing correction circuit by filtering of R2 and C1. It is accepted and conditioned by diode bridge D5, D6, D7, D8 and amplifier U2B to convert plus or minus signal polarities, which in this case is plus, to a positive output at pin 1. This, in turn, is compared to a positive threshold reference set by R3 by differential amplifier U3. This threshold is greatly exceeded by the saturated offset caused by the splice in sensor S2D2 and, as a result, a buffered signal to activate an alarm appears at the emitter output of transistor Q1. As the splice moves away from sensor pair S2D2 toward S1D1, and in a position between both sensor pairs, system balance is momentarily restored and the saturated amplifier output of U2A returns to null level. This level is significantly below the threshold reference determined by R3, and the alarm signal returns to zero. As web movement carries the splice to sensor pair S1D1, system imbalance repeats but with offset in the opposite direction or polarity. The conditioning circuit formed by the diode bridge and amplifier U2B, however, converts the resulting negative offset polarity to positive polarity at pin 1, where it again is compared to the set threshold to ultimately produce an additional alarm signal. Balance is restored once again as the splice leaves both detector pairs. The dual alarm pulse, which always results from a splice, serves as a redundancy.

The threshold level, adjusted and determined by R3, is set above normal offset signals, some of which are rapidly changing signals caused by disturbances, spots, etc., in the moving sheet. Tests for a variety of sheet materials, thick and thin, with overlap splices have demonstrated that only a single, initial adjustment was needed for R3 (refer to Table I). The same held true for the bias adjustment of R1.

The system, as described, because of its referencing to a continuously controlled null balance, can function normally and effectively with higher amplifier gain. This is not possible in the prior art without readjustment, which, at very high signal amplification, could still produce false alarm signals. The gain settings of U1A, U1B, and U2A were chosen arbitrarily to accommodate a wide range of popular sheet materials (reference Table I). The use of dual sensor pairs, where incident light is transmitted through the moving sheet material to measure sheet opacity, is not used in the prior art. This approach is not restricted to incandescent light sources, but allows the use of laser light beams to penetrate thicker, more opaque materials. Collimated light is preferred, as this would place no restriction on emitter to detector spacing in each sensor gap. This gap spacing can be relatively large to allow room for vibration and web flop that would otherwise endanger system performance and limit web speed. The light radiation is not restricted to the visible spectrum.

In summary, the disclosed offers several advantages not taught in the referenced patents or practiced in the prior art.

1. The use of a dual or plurality combination of radiant energy emitter to detector sensors measuring light transmission through a moving sheet and, consequently, an abrupt change in opacity due to an overlap splice.

2. The use of a dual or plurality combination of radiant energy emitter to detector sensors spaced apart in the direction of sheet movement to provide at least two saturated, redundant signals to trigger an alarm.

3. The use of a balancing and filtering circuit which responds to slow, gradual variations in product, components, and environmental effects to provide a compensation and correction signal for restoring balance.

4. The use of a balancing and filtering circuit to pass abrupt signal change from abrupt imbalance caused by overlap splice or tear-out to a conditioning and threshold current for alarm activation.

5. The use of collimation radiation beam not restricted necessarily to incandescent light, but laser light of some chosen wavelength to remove restriction on air gap spacing and consequent web speed limits.

6. A system, by virtue of radiation choice, that can function effectively for a wide variety of sheet materials.

7. A system which does not require opaque splice indicators.

8. A system which utilizes optical filtering to reduce, if not eliminate, influence of ambient light.

TABLE 1

| Test No. | Sample | Basis Weight (Grams/$M^2$) |
|---|---|---|
| 1 | Cigarette Paper | 22.7 |
| 2 | Stationery Paper | 77.6 |
| 3 | Printing Paper | 29.0 |
| 4 | Cork, Cigarette Tipping Paper | 38.1 |
| 5 | Coated, Cigarette Tipping Paper | 39.8 |
| 6 | Heavy Gloss Plotter Paper | 115.4 |

I claim:

1. A method of detecting discontinuities in a moving web, the steps comprising mounting a pair of radiant energy emitters on one side of a moving web, spacing the emitters apart in the direction of web travel a distance greater than the anticipated space of a web discontinuity, connecting the emitters in series to a power source, positioning a pair of detectors on the opposite side of the web in the field of radiant energy emitted from the emitters, connecting each of the detectors to a pair of amplifiers to produce opposing output signals, filtering the output signals to pass abrupt signal changes, connecting, continuously, the filtered output signals to the pair of amplifiers to thereby continuously compensate for the effects of slow, gradual environmental changes while passing abrupt signal changes to an output, further including the step of generating dual alarm pulses as the discontinuity sequentially passes the pair of detectors.

2. The method, as defined in claim 1, further including the step of mounting a pair of radiant energy filters, one for each detector, in the path of radiant energy emitted by the radiant energy emitters.

* * * * *